United States Patent [19]

Kulchin

[11] Patent Number: 4,952,097

[45] Date of Patent: Aug. 28, 1990

[54] PERMANENT CONCRETE WALL CONSTRUCTION AND METHOD

[75] Inventor: Steven A. Kulchin, Foster City, Calif.

[73] Assignee: Kulchin & Associates, Oakland, Calif.

[21] Appl. No.: 170,162

[22] Filed: Mar. 18, 1988

[51] Int. Cl.[5] ..... E02D 29/02

[52] U.S. Cl. ..... 405/262; 405/284; 405/286; 405/258

[58] Field of Search ..... 405/258, 262, 284, 286, 405/287, 285

[56] References Cited

U.S. PATENT DOCUMENTS

| | | | |
|---|---|---|---|
| Re. 28,977 | 9/1976 | Mason | 405/262 |
| 3,250,075 | 5/1966 | Webb et al. | 405/262 |
| 3,638,435 | 2/1972 | Mason | 405/262 |
| 3,802,204 | 4/1974 | Mason | 405/262 |
| 4,329,089 | 5/1982 | Hilfiker et al. | 405/262 |
| 4,391,557 | 7/1983 | Hilfiker et al. | 405/287 |
| 4,561,804 | 12/1985 | Weatherby | 405/262 |

*Primary Examiner*—Randolph A. Reese
*Assistant Examiner*—J. Russell McBee
*Attorney, Agent, or Firm*—Flehr, Hohbach, Test, Albritton & Herbert

[57] ABSTRACT

Permanent concrete wall construction disposed adjacent the face of an excavation cut in the earth and having a base comprising a plurality of soil anchors extending into the earth through the face of the excavation cut. The soil anchors include reinforcing elements which have a definite lifteime in excess of 50 years. The soil anchors have proximal extremities which extend outwardly away from the face of the cut. A permanent concrete wall extending upwardly from the base of the excavation with the proximal extremities of said soil anchors being buried within the concrete wall. The concrete wall has a finished architectural surface formed as an integral part thereof.

8 Claims, 2 Drawing Sheets

PERMANENT CONCRETE WALL CONSTRUCTION AND METHOD

This invention relates to a permanent concrete wall construction and method and more particularly to a permanent concrete wall construction and method which can be utilized for retaining walls, foundations and the like.

In U.S. Pat. Nos. 3,802,204, 3,638,435 and Reissue 28,977, there is disclosed a retaining wall and method for constructing the same. In connection with the disclosure therein, the retaining wall is used to support an embankment behind a cut. An array of grout-filled bore holes are placed in the embankment to form dowells and tendons which extend through the face of the embankment. Pneumatically applied concrete is used to form a skin upon the face of the embankment to bond with the earth mass and to the dowels or tendons which have been previously formed to stabilize the earth behind the skin and to support the skin. Use of such retaining walls has been limited principally to supporting embankments to provide a temporary lateral earth support. Heretofore applications of this retaining wall and a method for making the same have been generally limited to such temporary supports.

There is a need for a concrete wall construction which utilizes pneumatically applied concrete which can form a permanent support.

In general, it is an object of the invention to provide a permanent concrete wall construction and method.

Another object of the invention is to provide a wall construction of the above character which can serve as retaining walls, foundations and the like.

Another object of the invention is to provide a wall construction and method of the above character in which a composite wall is formed in which the retaining wall becomes a part of the composite wall construction.

Another object of the invention is to provide a wall construction and method of the above character which has substantial economies over existing wall constructions and methods.

Another object of the invention is to provide a wall construction and method of the above character which substantially reduces the required thickness of concrete formed in the wall.

Another object of the invention is to provide a wall construction and method of the above character in which the size of the footing for the wall can be greatly reduced and on certain occasions eliminated.

Another object of the invention is to provide a wall construction and method of the above character which reduces the amount of reinforcing elements required.

Another object of the invention is to provide a wall construction and method of the above character which reduces the amount of excavation required as well as eliminating the need for backfilling.

Another object of the invention is to provide a wall construction and method of the above character in which various architectural treatments can be utilized on the exterior exposed surface of the wall construction.

Additional objects and features of the invention will appear from the following description in which the preferred embodiments are set forth in detail in conjunction with the accompanying drawings.

Figure 1:
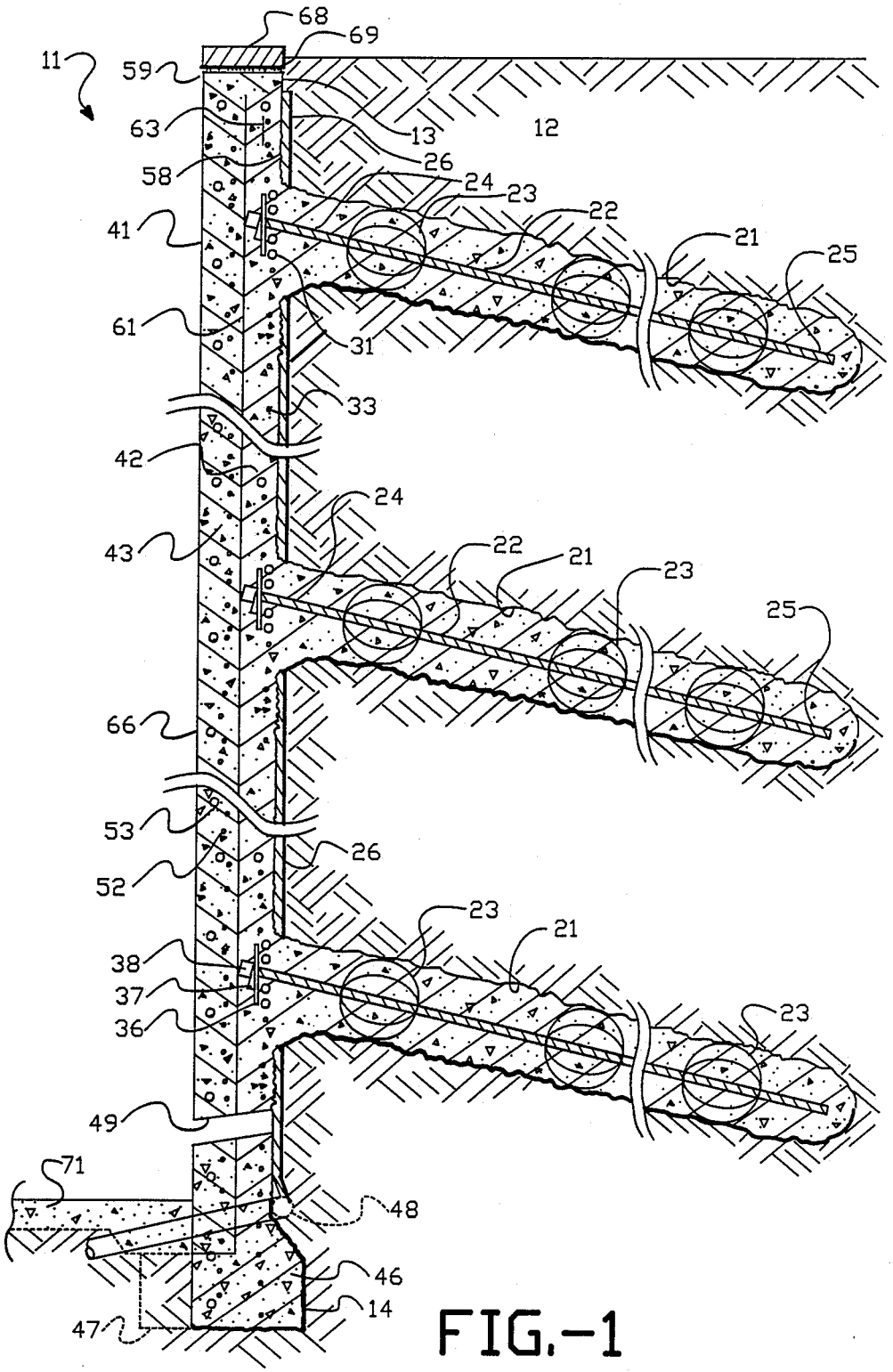
FIG. 1 is a cross-sectional view of a permanent concrete wall construction incorporating the present invention.

In general the permanent concrete wall construction of the present invention is disposed adjacent the face of an excavation cut formed in the earth. A plurality of soil anchors extend into the earth through the face of the excavation cut. The soil anchors are formed with reinforcing elements which have been fabricated to have a desired permanency. The soil anchors have proximal extremities which extend outwardly away from the face of the cut. A permanent concrete wall is pneumatically applied adjacent the excavation cut with the proximal extremities of the soil anchors being buried within the concrete wall. The concrete wall has a finished architectural surface which is incorporated into the wall as an integral part thereof.

More particularly as shown in the drawings, in preparation for the permanent concrete wall construction 11, excavation is carried out at a desired location in the earth 12 to provide the face 13. This face 13 can be substantially vertical as shown in the drawings or it can be inclined if desired. In accordance with the present invention, the excavation of the earth can be carried out in lifts of approximately 5 to 6 vertical feet each depending upon the condition of the soil or earth. For example three lifts have been provided in the wall construction shown in FIG. 1. This permits a wall construction of various heights to be provided which is also placed in lifts as hereinafter described. At the time the excavation is being carried out for the lowermost lift, a trench 14 is provided so that a footing of a conventional type can be prepared for supporting the wall construction.

In preparation for the fabrication of the permanent wall construction 11 after the excavation has been made for the first lift, a plurality of holes 21 are drilled into the soil or earth 12 from the face 13 a short distance above the bottom of the excavation for the first lift. The holes 21 can have a suitable size, as for example, ranging from 3 to 12 inches and can have a length ranging from 5 to 50 feet depending on the soil conditions encountered. Generally they should have a length which is approximately three fourths of the height of the wall. The holes are preferably drilled at downwardly extending angles as, for example, approximately 15° so that grout which is thereafter placed in the holes will not run out of the holes as hereinafter described. The holes 21 are preferably placed in a pattern in a face 13. For example, typically the holes are positioned midway between the bottom and top of a five foot lift and are spaced apart a suitable distance as, for example, 5 to 7 feet, also depending upon soil conditions. As the holes 21 are being drilled by one crew, tensile elements or rods 22 can be positioned in the holes 21 by another crew. Typically these tensile elements or rods 22 are conventional threaded bars having a suitable size and design strength, as for example, #8 reinforcing material. However, for the present application where the elements or rods are used in a permanent wall, elements or rods 22 must have a specifically designed lifetime, as for example, in excess of 50 years. As can be appreciated such an element or bar can be provided in a number of ways. For example, the #8 bar itself can be formed of material such as galvanized steel which is corrosion resistant. Alternatively, the exterior surface of the element 22 be coated with a corrosion inhibitor such as an epoxy. Also, if desired, plastic rods or fiber reinforced plastic rods can be used.

Spaced apart centering devices 23 of a conventional type are provided on the rods 22 and serve to maintain the rods 22 in the center of the holes 21.

Figure 2:
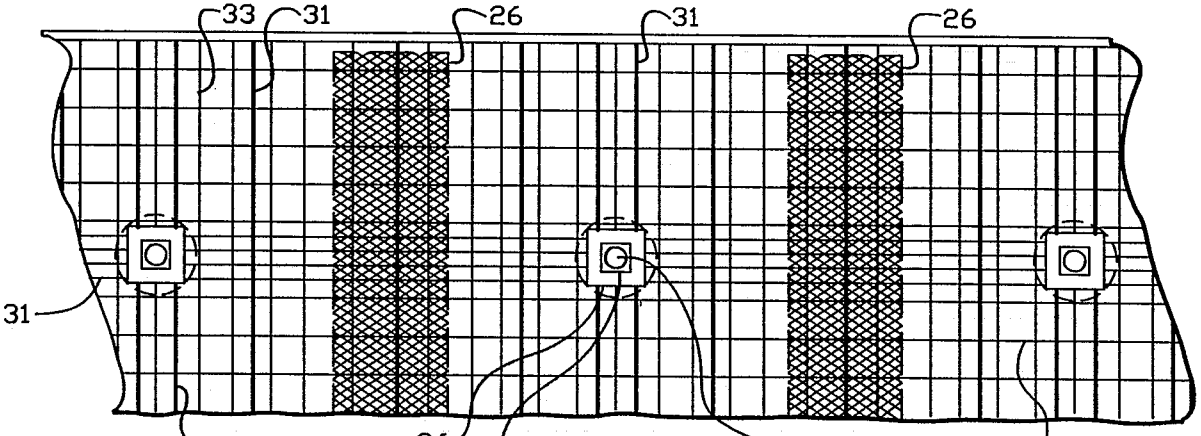
FIG. 2 is a front elevational view of a portion of the wall construction shown in FIG. 1 before the pneumatically applied concrete has been placed.
Figure 3:
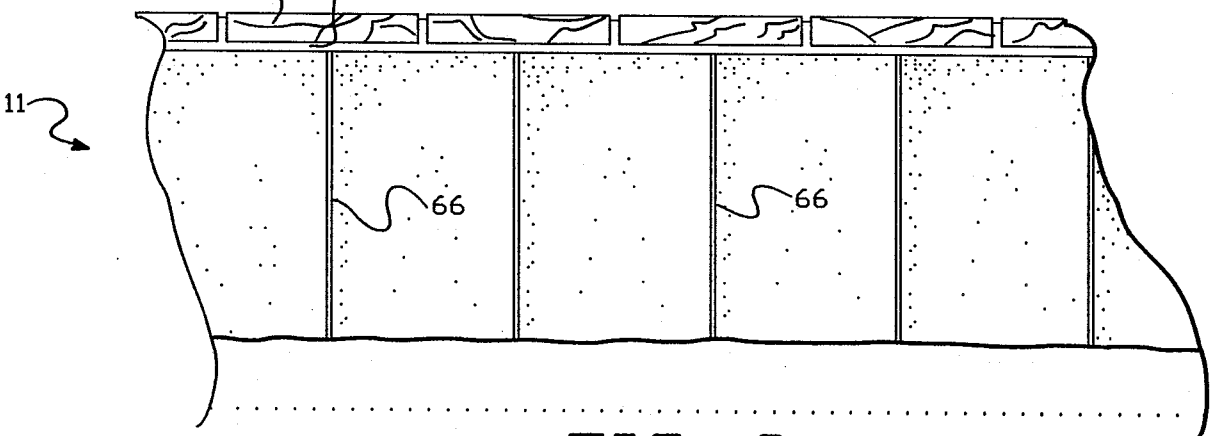
FIG. 3 is a front elevational view of the wall construction shown in FIG. 1.

At the same time that the hole drilling is taking place, suitable vertical drains 26 are placed on the face 13 so that any water collecting in the soil adjacent the wall to be constructed can drain vertically down along the exterior surface of the wall to be constructed The vertical drains 26 are positioned at horizontally spaced apart intervals as shown in FIG. 2. The vertical drain material 26 can be of a conventional type such as Miradrain or Amerdrain.

In order to provide suitable reinforcing for the permanent wall construction, reinforcing is installed in a conventional manner. Thus, for example, reinforcing bars or elements 31, often called rebar of a suitable size, as for example, #4 are spaced apart horizontally and vertically and wired together to form a rectangular grid pattern having a suitable spacing such as 12 inches.

The tensile elements or rods 22 are provided with proximal and distal extremities 24 and 25 in which the proximal extremity extends inwardly away from the face 13 so that the proximal extremity can be embedded in the concrete wall as hereafter described. The distal extremity extends to the distal extremity of the hole 21 formed in the soil.

Additional rebar elements 31 are provided on all four sides of each of the tensile elements or rods 22 and adjacent the same to provide additional reinforcing at these locations.

In addition to the reinforcing formed by the elements 31 or in place of the elements 31 a reinforcing wire 33 mesh is placed on the face 13 and is formed of a suitable material such as steel having a 6-inch by 6-inch square pattern formed of an appropriate size wire such as 6 to 10 gauge wire. It should be appreciated that if desired fibers can be incorporated into the shotcrete mix permitting a reduction or elimination of the conventional reinforcing.

After the tensile elements or rods 22 are placed and after the reinforcing material hereinbefore described is in place, pneumatically placed concrete (shotcrete) can then be applied to the face 13. A tremie tube is inserted into each of the holes 21 to fill the holes with shotcrete so that the entire hole is filled with concrete and surrounds the elements or rods 22.

Prior to placing of the shotcrete, wires (not shown) have been positioned to particularly define where the shotcrete wall is to be positioned relative to the face and where it is to terminate vertically. Also steel plates 36 are placed over the proximal ends of the rods 22. Coated washers 37 are then placed on the rods 22 and are forced into engagement with the plates 36 by nuts 38 threaded onto the rods 22. The shotcrete is then applied directly to the face 13 starting from the bottom of the lift which has been excavated and shooting the shotcrete to the desired thickness and desired elevation. The wall itself can be placed in a single application of shotcrete or more often it can be formed in first and second applications to provide a concrete wall 41 which can be characterized as a composite wall.

In the wall construction shown in FIG. 1, the wall construction has been placed in two applications in which the first application 42 is applied over the reinforcing material comprised of the mesh 33 and rebar elements 31 and over the plates 36, washers 37 and nuts 38 provided in the proximal extremities of the tensile elements or rods 22. It should be appreciated that if desired the proximal extremities of the tensile elements or rods 22 can be disposed inside of or outside of the first application 42 of shotcrete when two or more applications of shotcrete are utilized to form the composite wall 41. The first application 42 can be permitted to cure for a suitable period of time. While this is taking place, additional lifts can be prepared and installed in a similar manner until the bottom lift is reached, a footing 46 can be prepared also utilizing shotcrete. The footing 46 if desired can be L-shaped as shown by the broken line 47. In order to provide adequate drainage for water collecting at the bottom of the wall construction, collector pipes 48 exterior of the wall can be provided as shown or alternatively, weep holes 49 can be provided by inserting pipes (not shown) into the reinforcing prior to the application of the shotcrete so that water can weep into the interior of the wall structure and thereafter be collected and drained into a suitable sump.

After the first application 42 of shotcrete for the number of lifts required for the wall construction and after formation of the footing 46, the second application 43 of concrete can be applied. The reinforcing in both of the applications of concrete, as well as the thicknesses of the applications, is engineered so that the combination forms the composite wall having the desired permanency. Typically additional reinforcing can be installed over the first application and can be comprised of a wire mesh 52 of the type hereinbefore described as well as rebar elements 53 arranged in the desired pattern. As soon as this reinforcing is in place, the second application 43 in concrete can be pneumatically applied by utilizing shotcrete and applying it by starting from the bottom of the first application 42 which has been completed, progressively moving to the top to the desired elevation. As shown in FIG. 1, it is desirable that the second application 43 extend over the first application 42. Thus as shown in FIG. 1, the first application can be terminated at an elevation 58 with the second application terminating at an elevation of 59 which is shown spaced above the elevation 58. By constructing a second application 43 which extends over the top of the first application 42, the bonding surface 61 between the first and second applications 42 and 43 will be covered to ensure that water cannot seep into the wall along the bonding surface. A water stop 63 can be placed at the elevation 58 in the application 42 to further ensure that water cannot enter the bonding surface 61. In order to enhance the bond between the first and second application of shotcrete it is important that the outer surface of the first layer of shotcrete be clean and free of loose material. This typically can be accomplished by sandblasting, however, if desired a chemical treatment can be applied to the surface to enhance bonding.

The exterior surface 66 of the second application 43 of shotcrete while it is being applied or shortly thereafter can be finished in a manner so that it has an architectural finish suitable for a permanent wall construction. For example, shotcrete can be hand-trowelled to give the desired texture. Vertical seams 66 can be provided in the shotcrete. The outer surface can be sprayed with water after initial setting and partial curing has taken place but prior a final setting and curing to provide an exposed aggregate finish as shown in FIG. 1. Also, if desired, the shotcrete which is applied in the second application 43 can have at least portions thereof have a colored additive to provide a colored concrete appearance.

If desired, after completion of the first and second applications of shotcrete, a cap 68 formed of a suitable material such as concrete or granite can be mounted on top of the first and second applications of shotcrete by the use of grout 69. After the second application 43, a floor 71 can be placed.

From the foregoing, it can be seen that a composite wall construction has been provided which is free of piles as shown in the drawings and which can be utilized for retaining walls. It also can be utilized for structural walls for buildings as, for example, for basements and the like. It is placed in such a manner so that it can have a pleasing exterior surface to provide a finished architectural composite wall. Such a wall construction has many advantages It is economical in comparison to other types and methods of construction. The overall thickness of the wall is substantially reduced over that of conventional construction in view of the fact that the structure, i.e., the first application of shotcrete for stabilizing the face, forms an integral part of the permanent wall. In addition, the size of the footing required is greatly reduced and in many cases may actually be eliminated. Also the amount of reinforcing steel required for the wall construction is reduced. The amount of earth excavation required to form the wall construction and the elimination of form work and subsequent backfilling substantially reduces the cost of the wall construction. The wall construction is such that it can be readily engineered for the desired permanency by utilizing corrosion resistant reinforcing elements. The wall construction can also be readily designed to accommodate any hydrostatic pressures which may be encountered because of ground water.

In view of the fact that the wall construction utilizes shotcrete which is a conventional building material, numerous finishing techniques are possible to provide the desired architectural appearance. It should be appreciated that in place of a single wall to the height of the cut, a series of step walls which are offset horizontally one with respect to the other can be provided. As pointed out above, integral color pigments can be incorporated into the shotcrete. Alternatively, pigment dusts can be dusted onto the shotcrete, after it has been put into place. Chemical stains also can be utilized. Different textures can be obtained on the concrete by utilizing floats, various types of sandblasting and the like.

It should be appreciated that the wall construction and method herein disclosed can be utilized in many different applications as, for example, highway construction, site development walls, hillside integrated structures, landscape planter walls, slide and slope repair stabilization as well as basement wall constructions.

Although the present wall construction has been described as being utilized with soil anchors in which the tensile elements or rods are grouted into place, it is possible to utilize the present invention merely driving or vibrating the rods into the soil and eliminating the use of grout and still achieve the desired anchoring capabilities.

I claim:

1. A permanent concrete wall construction disposed adjacent the face of an excavation cut in the earth and having a base comprising a plurality of soil anchors extending into the earth through the face of the excavation cut, the soil anchors including reinforcing elements which have a definite lifetime in excess of 50 years, the soil anchors having proximal extremities which extend outwardly away from the face of the cut and a permanent concrete wall extending upwardly from the base of the excavation with the proximal extremities of said anchors being buried within said permanent concrete wall so that said anchors do not protrude through the permanent concrete wall, said permanent concrete wall being free of piles and being formed of first and second applications of pneumatically applied concrete with a bonding surface therebetween, said second application having a finished architectural surface formed as an integral part thereof said wall further comprising reinforcing elements in each of said first and second applications.

2. A concrete wall construction as in claim 1 wherein the proximal extremities of the reinforcing elements of the soil anchors extend into at least a portion of the first application of said permanent concrete wall.

3. A wall construction as in claim 2 in which the architectural surface is of a type that is formed while the pneumatically applied concrete is curing.

4. A wall construction as in claim 1 wherein said first application of concrete extends to a top level which is less than that of the top level of the second application, said second application extending over the first application to cover the bonding surface between the first and second applications.

5. A wall construction as in claim 1, together with a water stop disposed in the first application at the top level of the first application to prevent water from entering onto the bonding surface.

6. A method for forming a permanent concrete wall construction disposed adjacent the face of an excavation cut formed in the earth, comprising the steps of placing a plurality of soil anchors formed of reinforcing elements having a lifetime in excess of 50 years extending into the earth from the face of the excavation cut in such a manner so that the proximal extremities of the soil anchors extend inwardly from the face of the cut, applying reinforcing over the face of the cut extending across the proximal extremities of the soil anchors, pneumatically applying a first application of concrete to the face of the cut to cover the reinforcing elements and to cover at least portions of the proximal extremities of the soil anchors and to provide a bonding surface to provide a concrete wall with a bonding surface which forms at least a portion of the permanent concrete wall construction, pneumatically applying a second application of concrete which is bonded to the exterior surface of the first application of concrete to provide a permanent concrete wall construction having an exterior surface in which the exterior surface of the second application has an architectural finish through which the soil anchors do not protrude and placing additional reinforcing adjacent to the first application of concrete prior to the second application of concrete so that the additional reinforcing is embedded in the second application of concrete, said first named reinforcing and said additional reinforcing in combination with the first and second applications of concrete being engineered to provide the permanent concrete wall structure.

7. A method as in claim 6 together with the step of terminating the first application of concrete at an elevation less than the elevation of the second application of concrete and applying the second application of concrete so that the upper extremity of the same extends over the top of the first application of concrete so that the bonding surface between the first and second applications is covered by the second application of concrete.

8. A method as in claim 6 together with the step of treating the exterior surface of the second application of concrete while the second application is curing to provide the architectural finish on the exterior surface.

* * * * *